US008517434B1

(12) United States Patent
Reep, Sr.

(10) Patent No.: US 8,517,434 B1
(45) Date of Patent: Aug. 27, 2013

(54) POCKET DOOR LATCH

(76) Inventor: Richard Thomas Reep, Sr., Jacksonville, FL (US)

( * ) Notice: Subject to any disclaimer, the term of this patent is extended or adjusted under 35 U.S.C. 154(b) by 0 days.

(21) Appl. No.: 13/526,870

(22) Filed: Jun. 19, 2012

(51) Int. Cl.
*E05C 5/00* (2006.01)
*E05C 3/16* (2006.01)

(52) U.S. Cl.
USPC ..... 292/65; 292/200; 292/219; 292/226; 292/DIG. 46; 49/394

(58) Field of Classification Search
None
See application file for complete search history.

(56) References Cited

U.S. PATENT DOCUMENTS

| | | | | | |
|---|---|---|---|---|---|
| 368,684 | A | * | 8/1887 | Phillips | 292/224 |
| 1,376,122 | A | * | 4/1921 | Songey | 292/57 |
| 1,696,870 | A | * | 12/1928 | Spencer | 292/57 |
| 1,744,424 | A | * | 1/1930 | Trudeau | 292/332 |
| 1,875,768 | A | * | 9/1932 | Smith | 292/217 |
| 2,376,102 | A | * | 5/1945 | Voight et al. | 70/135 |
| 2,458,751 | A | * | 1/1949 | Voight | 292/198 |
| 2,631,877 | A | * | 3/1953 | Ainsworth | 292/57 |
| 2,701,156 | A | * | 2/1955 | Palmer, Jr. | 292/113 |
| 2,727,771 | A | * | 12/1955 | Adams | 292/17 |
| 3,012,430 | A | * | 12/1961 | Spork | 70/99 |
| 3,025,693 | A | * | 3/1962 | Braginetz | 70/100 |
| 3,046,043 | A | * | 7/1962 | Matteson | 292/175 |
| 3,400,491 | A | * | 9/1968 | Hole | 49/394 |
| 3,798,935 | A | * | 3/1974 | Blekking et al. | 70/100 |
| 3,804,440 | A | * | 4/1974 | Carey | 292/58 |
| 3,843,175 | A | * | 10/1974 | Klebba | 292/216 |
| 4,505,501 | A | * | 3/1985 | Fuchs et al. | 292/62 |
| 4,702,095 | A | * | 10/1987 | Ben-Asher | 70/279.1 |
| 4,744,392 | A | * | 5/1988 | Tade et al. | 138/89 |
| 5,275,029 | A | * | 1/1994 | Myers | 70/128 |

* cited by examiner

*Primary Examiner* — Carlos Lugo
*Assistant Examiner* — Thomas Neubauer
(74) *Attorney, Agent, or Firm* — Thomas C. Saitta

(57) ABSTRACT

A latchset for a sliding pocket door, the latch being actuated by depressing a handbar on either the inside or outside of the door to rotate the latch member relative to a keeper member located in the door frame, the latchset having cam members to transfer rotation from the handbar axles to the latch axle. The latchset may be provided with locksets of differing mechanisms whereby the door may be locked to the outside.

14 Claims, 15 Drawing Sheets

POCKET DOOR LATCH

BACKGROUND OF THE INVENTION

This invention relates generally to the field of latchsets for sliding doors, and particularly to the field of latchsets for sliding pocket doors, both with or without locksets.

A latchset for pocket doors can be generally defined as the hardware set that latches the door in a closed position, along with the operational components, e.g., one or more handles, that allow the latch to be released from the keeper so that the door can be opened. A latchset may also be combined with a lockset that allows the door to be locked in the closed position from one or both sides. Many of the known latchsets and locksets utilize thumbturns or other relatively small actuating members that must be grasped between the thumb and fingers in order to open or lock the sliding pocket door. This can be difficult for individuals suffering from arthritis or other conditions where dexterity is impaired. The use of larger actuating members is limited by the fact the pocket door is fully received within a wall pocket when the door is fully opened, and therefore it is imperative that the latchset or lockset actuating members be flush with or recessed within the door panel so that they do not preclude sliding the door completely into the recess.

It is an object of this invention to provide a latchset or a latchset and lockset combination adapted for a pocket door that addresses the dexterity problems presented by standard pocket door latchsets by providing an operating structure that presents a larger actuating member or members to the user, the actuating members being flush with or recessed within the door panel such that they do not interfere with sliding the pocket door completely into the door recess in the wall. It is a further object to provide such a latchset or latchset and lockset combination that is accessible from both sides of the door.

SUMMARY OF THE INVENTION

In a basic embodiment, the invention is a sliding pocket door latchset comprising a case that is mounted into a cut-out portion on the edge of a pocket door panel, the case being exposed on both the inside and the outside of the pocket door panel. An exposed first handbar or lever member and an exposed second handbar or level member are positioned horizontally within recesses in the case, one on the inside and the other on the outside, and a rotatable latch member is exposed on the end of the case. The latch member is mounted onto a latch axle which extends into the interior of the case. A keeper member is positioned within the door frame channel, optionally within a receiver channel member that is mounted in the door frame channel, such that with the door panel closed against the door frame channel the latch member is held by the keeper member to prevent opening of the door until the latch member is rotated so as to be freed from the keeper member.

The first handbar member is longitudinally mounted to a first handbar axle such that depressing the first handbar member results in rotation of the first handbar axle, which extends beyond the first handbar member in the axial direction and into the interior of the case. A first handbar axle cam is mounted to the extended portion of the first handbar axle and engages a first axle cam mounted onto the latch axle, whereby depression of the first handbar member results in rotation of the latch axle and the latch member. The second handbar member is longitudinally mounted to a second handbar axle such that depressing the second handbar member results in rotation of the second handbar axle, which extends beyond the second handbar member in the axial direction and into the interior of the case. A second handbar axle cam is mounted to the extended portion of the second handbar axle and engages a first idler axle cam mounted to an idler axle. A second idler axle cam is mounted on the opposite side of the idler axle from the first idler axle cam. The second idler axle cam engages a second axle cam mounted onto the latch axle, whereby depression of the second handbar member results in rotation of the latch axle and the latch member. The idler axis is utilized such that depression of either handbar member rotates the latch member in the same direction from a neutral or latching orientation to an open orientation wherein the latch member is no longer retained by the keeper member and the door panel can be slid open. Various spring members are utilized to return the latch member to the neutral orientation when the handbar members are released.

In alternative embodiments, lockset mechanisms may be provided in combination with the latchset whereby the pocket door may be locked from one or both sides.

DETAILED DESCRIPTION OF THE INVENTION

Figure 1:
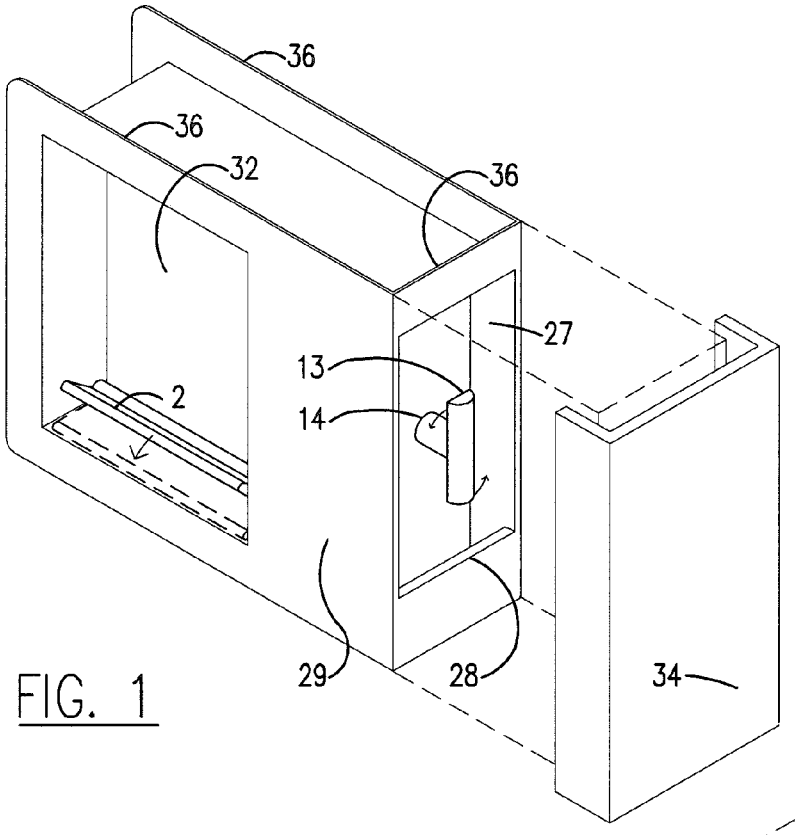
FIGS. 1 and 2 are inside perspective views of a basic embodiment of the latchset, shown in expanded form.
Figure 2:
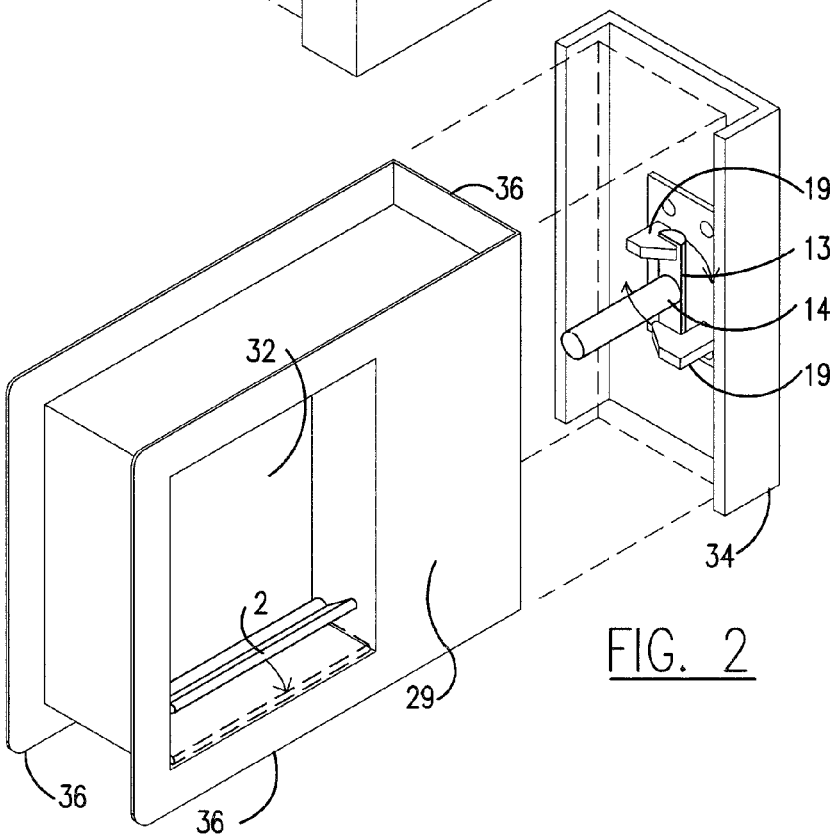
Figure 3:
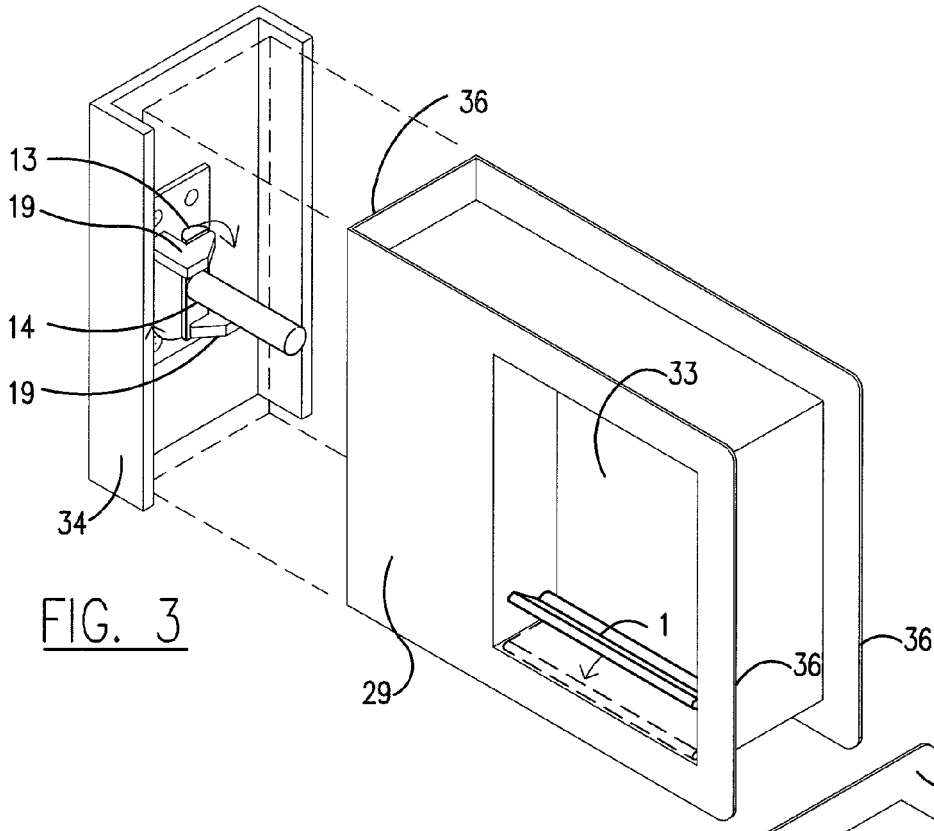
FIGS. 3 and 4 are outside perspective views of the basic embodiment of the latchset shown in FIGS. 1 and 2, shown in expanded form.
Figure 4:
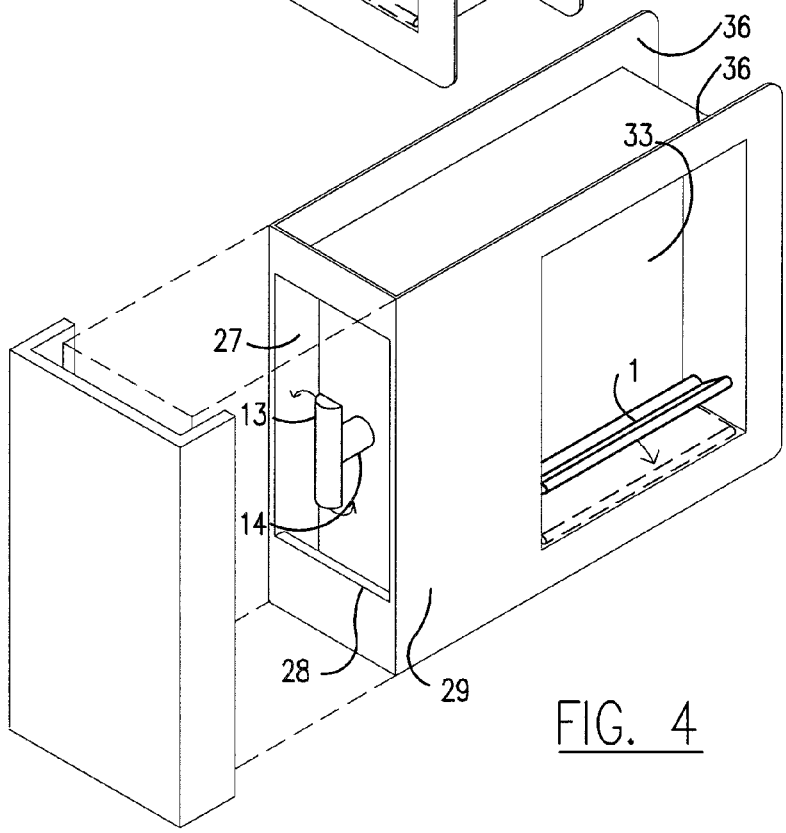

With reference to the drawings, the invention will now be described in detail with regard for a best mode and preferred embodiment or embodiments. In a broad and general sense, the invention is a sliding pocket door latchset adapted to retain the pocket door in the closed position that precludes sliding movement of the door until a handbar member is actuated to release the latch member and allow the door to slid open. The latchset is structured so as to be flush or recessed within the door panel such that the door may be fully inserted into a wall pocket adapted to receive the door. As used herein, the terms side or face shall refer to the inside or outside surfaces of the door panel, or be taken to be in the direction of the inside or outside door panel surfaces, and the terms end or edge shall refer to the end or edge of door panel facing the door frame, or be taken to be in the direction of the door panel edge or end.

A basic embodiment of the pocket door latchset is illustrated in FIGS. 1 through 12 and 22. FIGS. 1 through 4 present views of the latchset showing the components as adapted and constructed to be mounted within the pocket door and the components as adapted and constructed to be mounted within the door frame channel 46. The latchset comprises a housing or case 29 adapted to be inserted into, received by and attached to a substantially rectangular or square slot or opening provided in the edge of the door panel 35, the opening passing through both sides of the door panel 35. Preferably the case 29 is provided with peripheral flange members 36 that are relatively flush with the sides and edges of the door panel 35 surrounding the opening. The latchset further comprises a keeper member 19 mounted within the door frame channel 46. The latchset may optionally further comprise a receiver channel member 34 adapted to be mounted within the door frame channel, the keeper member 19 being mounted to the receiver channel member 34. The keeper member 19 may extend out from the back wall of the receiver channel member 34, as shown in the drawings, or may be mounted directly into the door frame channel 46. A latch member 13 is mounted onto a latch axle 14 and extends toward or beyond the exposed end of the case 29 in a manner that allows the latch member 13 to interlock or otherwise be retained by the keeper member 19 when the door panel 35 is in the fully closed position, the latch member 13 rotating about the latch axle 14 to interlock with and free itself from the keeper member 19. As shown in the drawings, the case 29 may be provided with a latch recess 27 defining a pocket wall 28 which may be gripped in order to slide the door from its fully open position.

Figure 21:
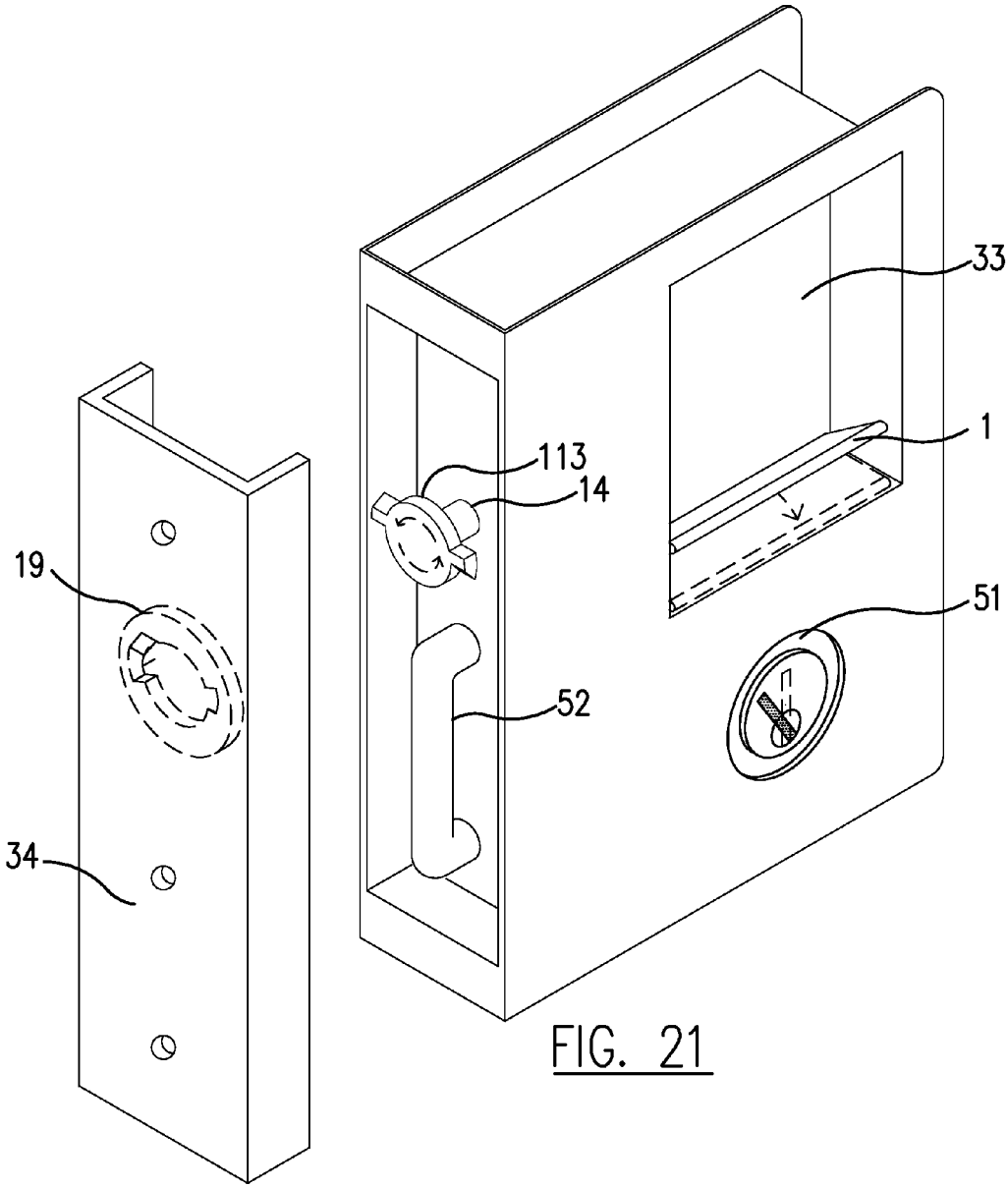
FIG. 21 is an expanded outside perspective view showing an alternative variation of the alternative embodiment of FIG. 19.
Figure 22:
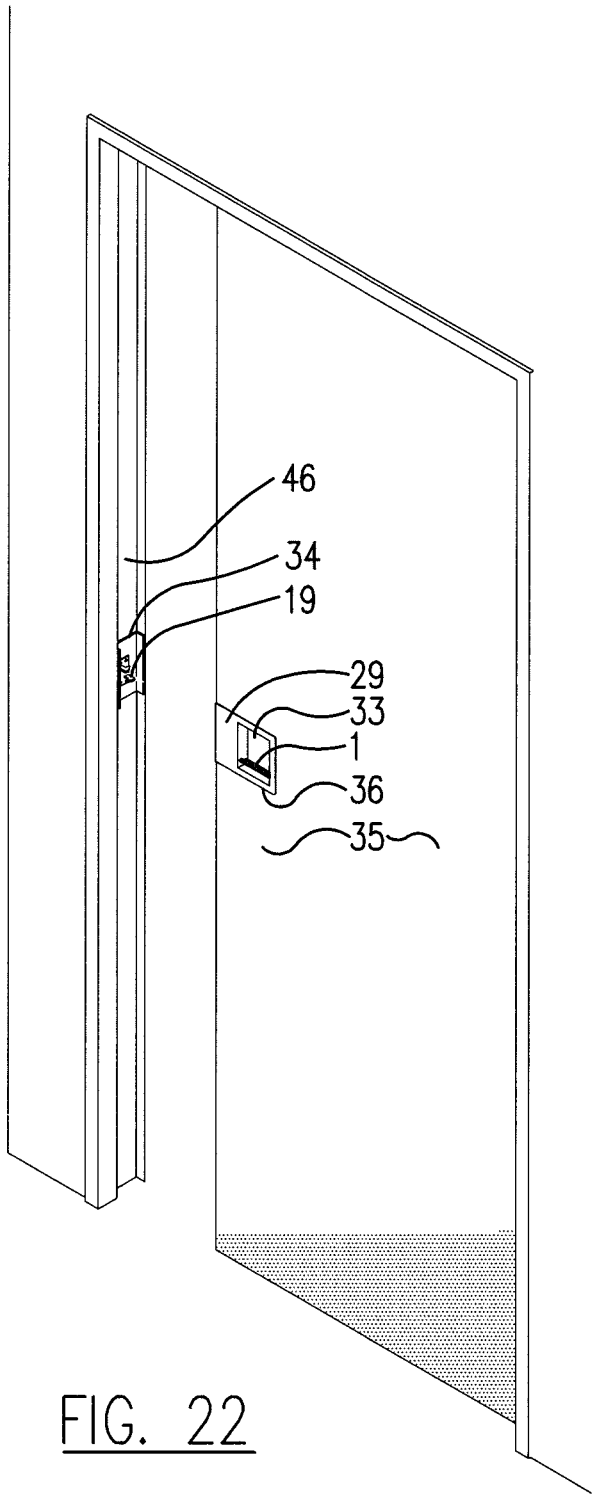
FIG. 22 is a perspective view of an embodiment of the invention in association with a pocket door and door frame.

In the illustrated embodiment the latch member 13 comprises a bar having a rounded front and a flat rear mounted perpendicularly onto the end of the latch axle 14 and the keeper member 19 comprises a pair of hook or arm members defining slots to receive the bar of the latch member 13, the arm members presenting beveled or sloping exterior surfaces such that as the latch member 13 comes into contact with the keeper member 19 when the door is closed, the latch member 13 is forced to rotate out of the neutral orientation until the door is fully closed and the bar of the latch member 13 snaps into the slots defined by the arm members of the keeper member 19. The latch member 13 is maintained in the neutral orientation by latch axle spring member 18, which is mounted within the case 29 by a spring mount 31 and is joined to a latch axle spring arm 12 extending from the latch axle 14. Alternative structures and designs for the latch member 13 and keeper member 19 are known in the art, and the embodiment as shown in the drawings is not meant to be limiting but is meant to present one of many possible obvious variations, as any combination of such wherein the latch member 13 rotates or displaces relative to the keeper member 19 would function in suitable manner. For example, as shown in FIG. 21, the latch member 113 comprises a disc-shaped member having opposing tab members extending in the radial direction, and keeper member 19 comprises an opening with radial slots in the receiver channel member 34 sized and configured to allow passage of the latch member 113 therethrough. Rotation of the latch member 113 results in the tab members being retained by the receiver channel 34 such that the panel door 35 cannot be opened. A handle 52 may be provided in known manner for easier movement of the panel door 35 from the wall recess when the pocket door is fully open. Another alternative embodiment (not illustrated) for the latch member 13 is to form the latch member as a single bar or rod mounted at a 90 degree angle on the end of the latch axle 14 to define an L-shaped configuration.

Each side of the case 29 is provided with a first handbar recess 33 and a second handbar recess 32. For ease of reference with regard to the illustrations, the first handbar recess 33 may be considered to be located on the outside of the pocket door and the second handbar recess 32 may be considered to be located on the inside of the pocket door, however it is to be understood that the inside and outside operational mechanisms and structures to be described later may be reversed in some circumstances without altering the basic functioning of the latchset. The first and second handbar recesses 33 and 32 are sufficiently large so that bent fingers or even a first may be inserted into the recesses 33 and 32 in order to actuate the latchset. The first handbar member 1 is an elongated flange member located toward the bottom of the first handbar recess 33 and is disposed generally horizontally, the handbar member 1 being positioned such that there is sufficient clearance for it to be depressed downward. The second handbar member 2 is similarly located in the second handbar recess 32, and is also an elongated flange member disposed in a generally horizontal orientation. The first handbar member 1 is longitudinally joined to a first handbar axle 3 and the second handbar member 2 is longitudinally joined to a second handbar axle 4. The first handbar axle 3 extends from handbar 1 within handbar recess 33 and into the interior of case 29, and the second handbar axle 4 extends from handbar 2 within handbar recess 32 and into the interior of case 29, both extending in the direction of the end of case 29. The handbar members 1 and 2 and their dedicated handbar axles 3 and 4 are configured such that depressing the handbar members 1 or 2 downward results in rotation of the handbar axles 3 or 4, respectively, about their respective longitudinal axes. Preferably, the handbar members 1 and 2 angle upward in the neutral position such that when depressed they lie relatively flat against the base of the recesses 33 and 32 in a substantially horizontal orientation, respectively.

The operational mechanisms or components are best seen in FIGS. 5 through 12. Actuation, i.e., depression, of either handbar member 1 or 2 results in rotation of latch axle 14 and latch member 13 in the same direction, latch axle spring member 18 being extended and put into tension as the latch axle 14 is turned. With the panel door 35 is in the closed position and either handbar member 1 or 2 depressed, the latch member 13 is rotated a small number of degrees from the neutral orientation, shown as vertical in the drawings, such that the latch member 13 clears the keeper member 19 and the door panel 35 may be opened.

The operational mechanism for the first handbar member 1 is illustrated in FIGS. 6, 8 10 and 11. A first handbar axle spring arm 10 is joined to the portion of the first handbar axle 3 residing within the case 29, the first handbar axle spring arm 10 extending outward in a generally radial direction. A first handbar axle spring 9 is mounted to the case by a spring mount 31 and connects to first handbar axle spring arm 10 in a manner whereby first handbar member 1 and first handbar axle 3 are retained in the neutral orientation until first handbar member 1 is depressed, thereby placing first handbar axle spring 9 in tension. Upon release of first handbar member 1, first handbar axle spring 9 then returns the first handbar member 1 and first handbar axle 3 to the neutral orientation. A first handbar axle cam 5 is connected to the portion of the first handbar axle 3 residing within the case 29, the first handbar axle cam 5 extending outward from the first handbar axle 3 in a generally radial direction. The first handbar axle cam 5 is preferably a relatively thin, extended flange member and may be curved or angled, especially near its free end. The first handbar axle cam 5 is positioned to abut and engage a first latch axle cam 15 that is joined to the latch axle 14, the first latch axle cam 15 extending outward from the latch axle cam 14 in a generally radial direction, and may be curved or angled, especially near its free end. First handbar axle cam 5 and first latch axle cam 15 are configured such that constant contact is maintained throughout rotation of first handbar axle 3.

With this arrangement, with rotational directions being as shown in the drawings, as first handbar member 1 is actuated, first handbar axle 3 rotates and pivots first handbar axle cam 5 in an arced clockwise manner. First handbar axle cam 5 pushes against first latch axle cam 15, causing latch axle 14 and latch member 13 to be rotated in a counter-clockwise direction, as shown by the dashed lines in FIG. 11. Upon release of the first handbar 1, first handbar axle spring 9 retracts and rotates first handbar axle 3 counter-clockwise back into the neutral position and latch axle spring 18 retracts and rotates latch axle 14 and latch member 13 clockwise back into the neutral position.

Figure 5:
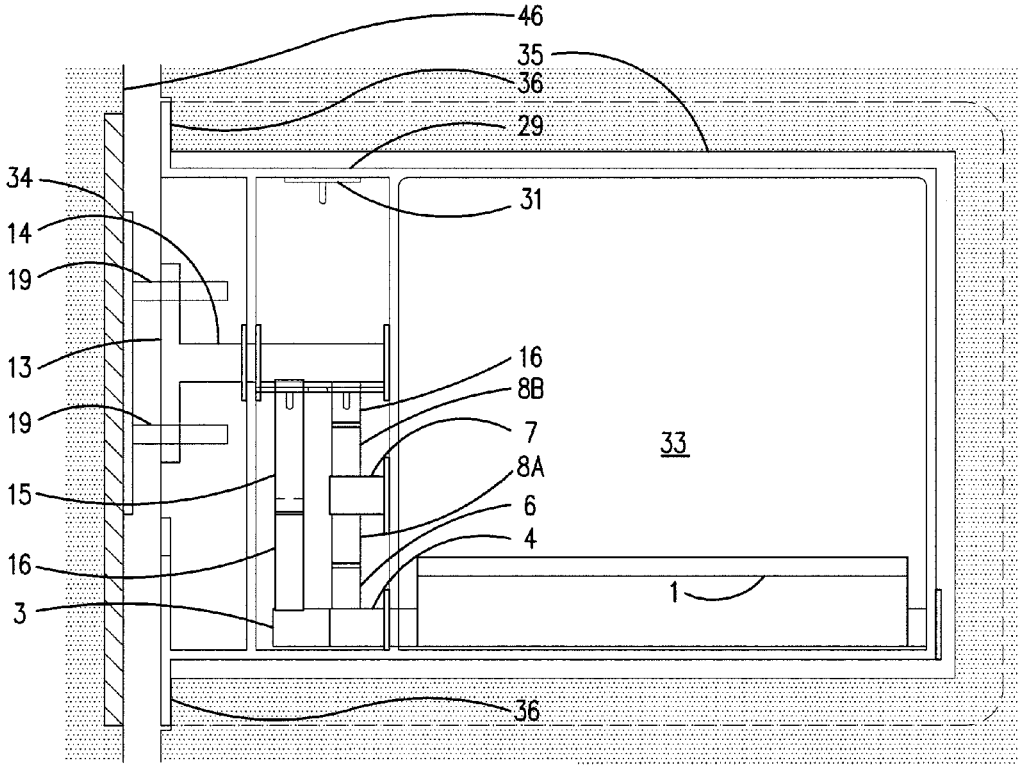
FIG. 5 is an outside partially exposed view of the basic embodiment of the latchset.
Figure 6:
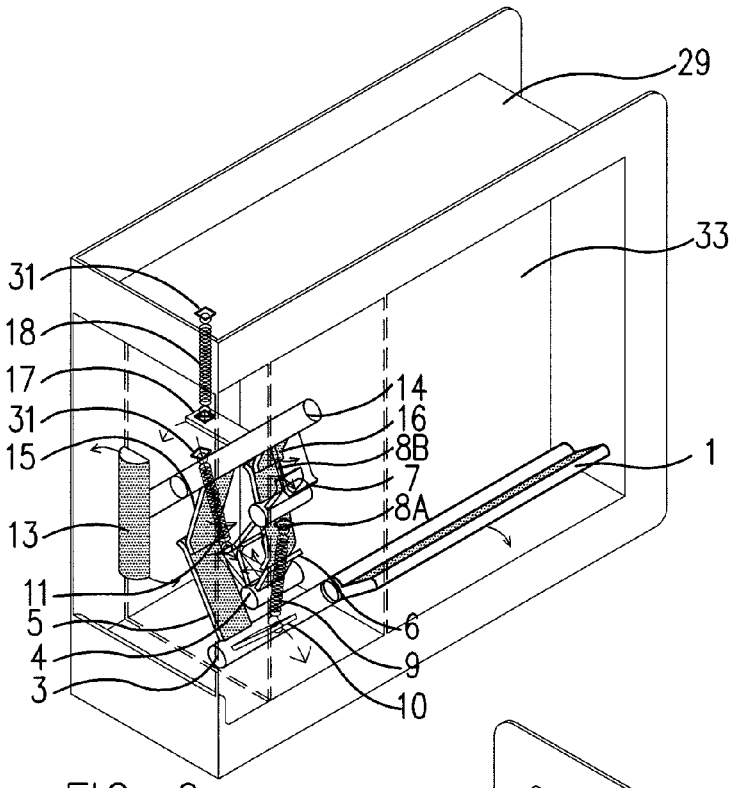
FIG. 6 is a partially exposed, outside perspective view of the operating mechanisms of the basic embodiment of FIG. 4.
Figure 7:
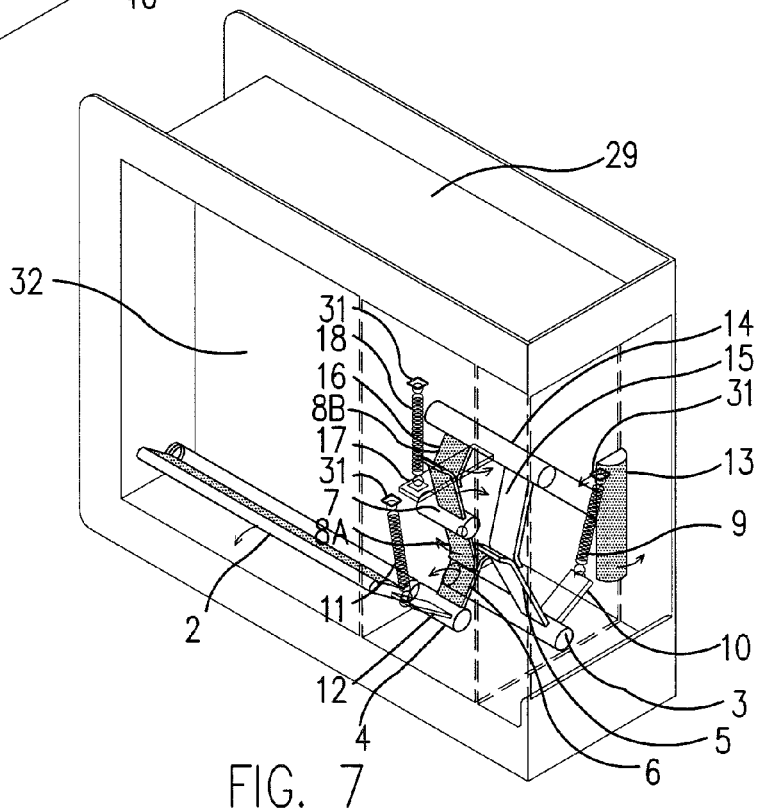
FIG. 7 is a partially exposed, inside perspective view of the operating mechanisms of the basic embodiment of FIG. 1.
Figure 8:
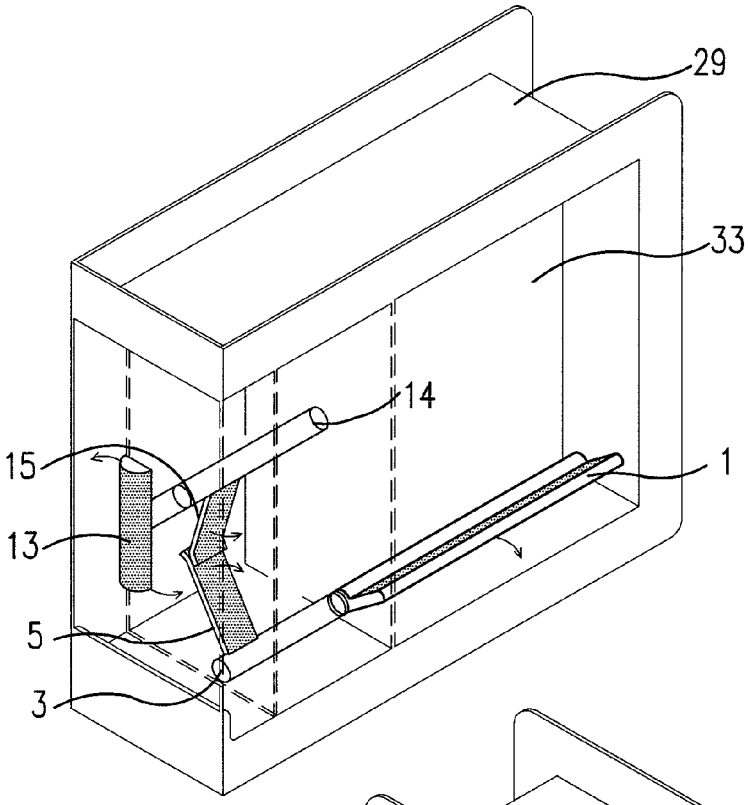
FIG. 8 is a view similar to the basic embodiment shown in FIG. 6 illustrating the outside operating elements.
Figure 9:
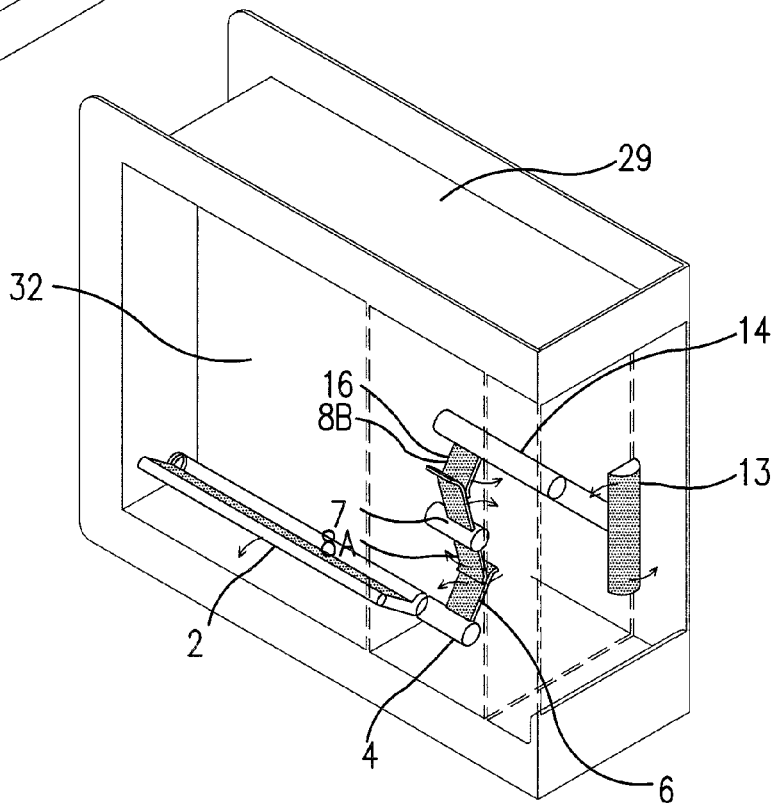
FIG. 9 is a view similar to the basic embodiment shown in FIG. 7 illustrating the inside operating elements.
Figure 10:
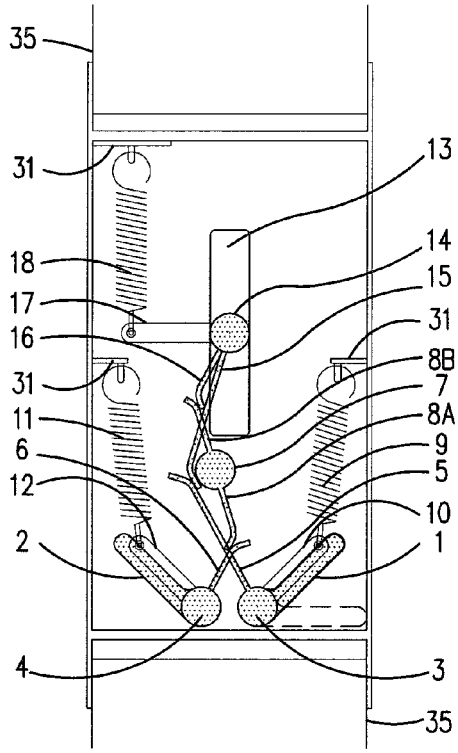
FIG. 10 is an exposed end view of the operating mechanisms of the basic embodiment of the latchset.
Figure 11:
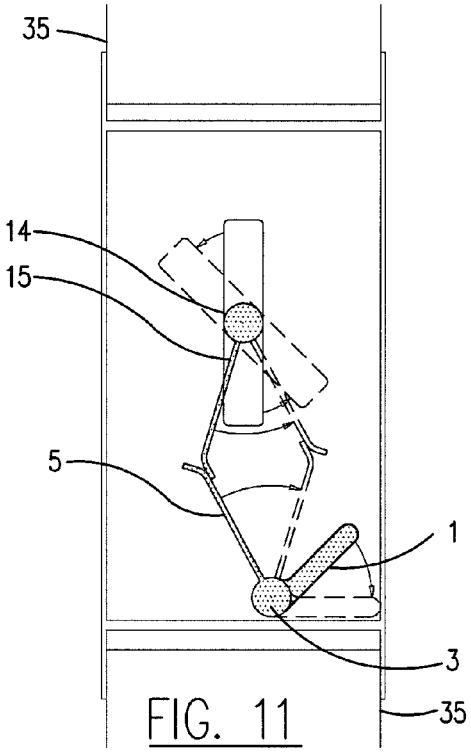
FIG. 11 is an exposed end view of the outside operating elements.
Figure 12:
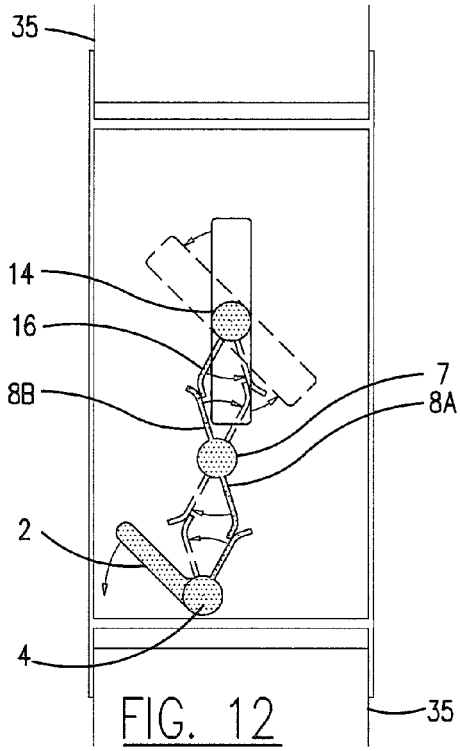
FIG. 12 is an exposed end view of the inside operating elements.

The operational mechanism for the second handbar member 2 is illustrated in FIGS. 7, 9, 10 and 12. A second handbar axle spring arm 12 is joined to the portion of the second handbar axle 4 residing within the case 29, the second handbar axle spring arm 12 extending outward from the second handbar axle 4 in a generally radial direction. A second handbar axle spring 11 is mounted to the case 29 by a spring mount 31 and connects to second handbar axle spring arm 12 in a manner whereby second handbar member 2 and second handbar axle 4 are retained in the neutral orientation until second handbar member 2 is depressed, thereby placing second handbar axle spring 11 in tension. Upon release of the second handbar member 2, second handbar axle spring 11 then returns the second handbar member 2 and second handbar axle 4 to the neutral orientation. A second handbar axle cam 6 is connected to the portion of the second handbar axle 4 residing within the case 29, the second handbar axle cam 6 extending outward from the second handbar axle 4 in a generally radial direction. The second handbar axle cam 6 is preferably a relatively thin, extended flange member and may be curved or angled, especially near its free end. A second latch axle cam 16 is joined to the latch axle 14, the second latch axle cam 16 extending outward from the latch axle 14 in a generally radial direction, and may be curved or angled, especially near its free end. The second latch axle cam 16 and the first latch axle cam 15 are separated along the latch axle 14 in the axial direction, as shown in FIG. 5. An idler axle 7 is disposed between the latch axle 14 and the second handbar axle 4, all three axles being parallel. A lower idler axle cam 8*a* and a generally opposing upper idler axle cam 8*b* are joined to the idler axle 7, each extending outward from the idler axle 7 in a generally radial direction and preferably being a relatively thin, extended flange member that may be curved or angled, especially near its free end. The lower idler axle cam 8*a* is positioned to abut and engage the second handbar axle cam 6 while the upper idler axle cam 8*b* is positioned to abut and engage the second latch axle cam 16. Second handbar axle cam 6 and lower idler axle cam 8*a* are configured such that constant contact is maintained throughout rotation of second handbar axle 4. Likewise, second latch axle cam 16 and upper idler axle cam 8*b* are configured such that constant contact is maintained throughout rotation of second handbar axle 4.

With this arrangement, as second handbar member 2 is actuated, second handbar axle 4 rotates and pivots first handbar axle cam 6 in an arced counter-clockwise manner. Second handbar axle cam 6 pushes against lower idler axle cam 8*a*, rotating idler axle 7 and pivoting upper idler axle cam 8*b* in a clockwise direction. Upper idler axle cam 8*b* then pushes against second latch axle cam 16, causing latch axle 14 and latch member 13 to be rotated in a counter-clockwise direction, as shown by the dashed lines in FIG. 12. Upon release of the second handbar 2, second handbar axle spring 11 retracts and rotates second axle 4 back into the neutral position and latch axle spring 18 retracts and rotates latch axle 14 and latch member 13 back into the neutral position.

Figure 13:
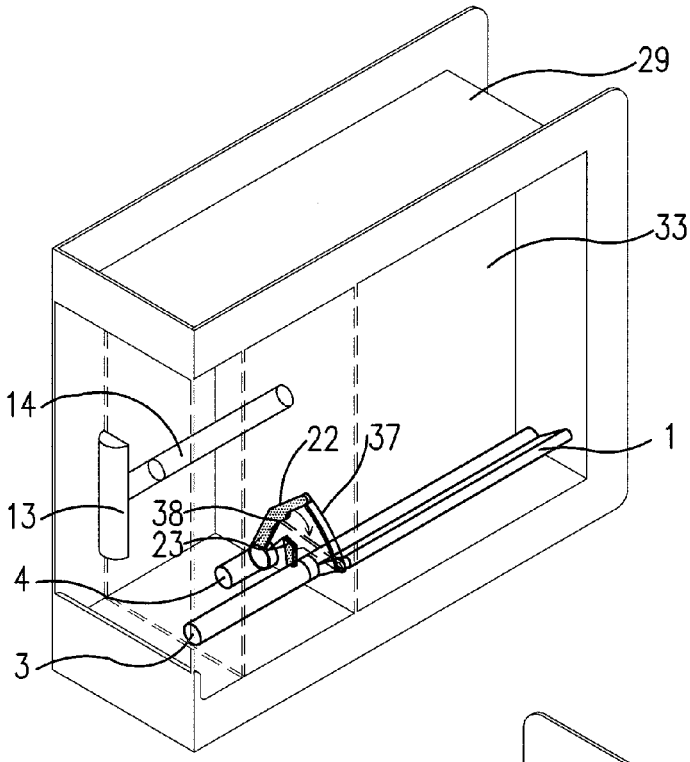
FIG. 13 is a partially exposed outside view of a first alternative embodiment of the latchset further comprising a lockset.
Figure 14:
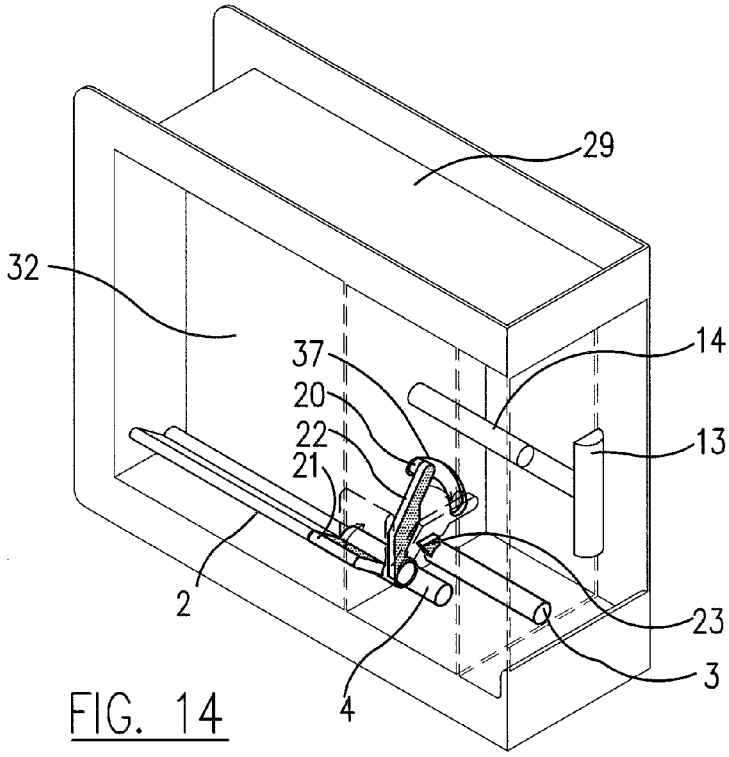
FIG. 14 is a partially exposed inside view of the first alternative embodiment of FIG. 13.
Figure 15:
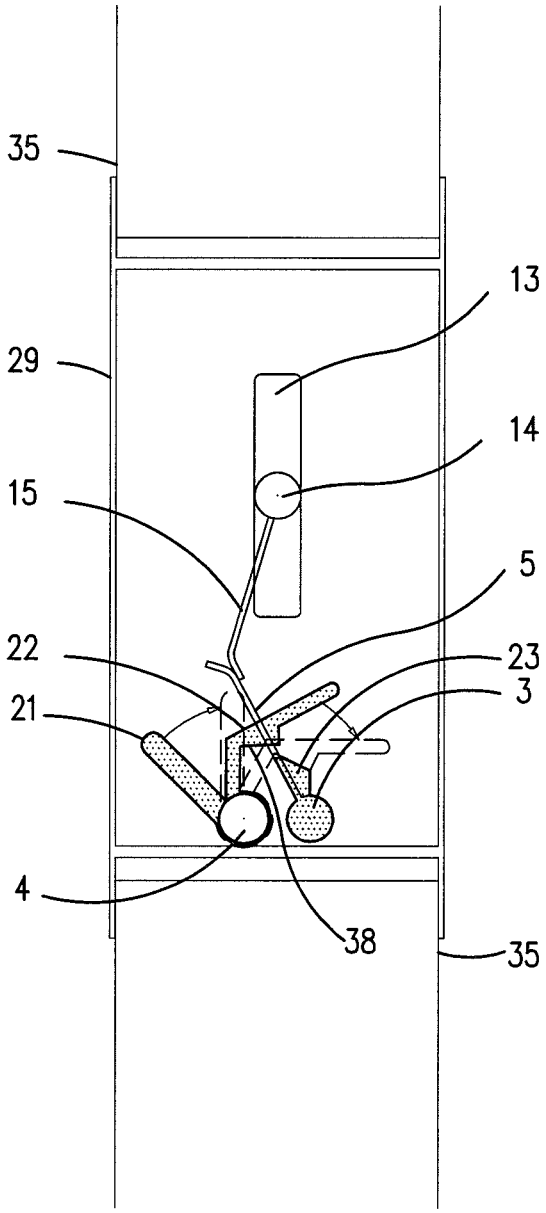
FIG. 15 is an exposed end view showing the first alternative embodiment of FIG. 13.

In a first alternative embodiment illustrated in FIGS. 13 through 15, the latchset is provided with a privacy assembly or lockset that enables the pocket door to be locked from the inside when closed. A privacy activation lever 21 is coaxially mounted onto second handbar axle 4 within second recess 32, which in this case will be the inside recess, replacing a portion of handbar 2. The privacy activation lever 21 is able to pivot about second handbar axis 4 independently, such that second handbar member 2 may be depressed without moving privacy activation lever 21. A lock arm member 22 is connected to privacy activation lever 21 and extends in a generally radial direction within case 29. In this embodiment, a first handbar axle stop member 23 is connected to the first handbar axle 3. Lock arm member 22 comprises an abutment surface 38, and the lock arm member 22 and the first handbar stop member 23 are aligned such that when the privacy activation lever 21 is raised, lock arm member 22 pivots until the abutment surface 38 contacts first handbar axle stop member 23, thereby precluding rotation of first handle axle 3 and preventing the door from being unlocked from the outside. The first recess 33 may be provided with an access slot 37 that aligns with the end of the lock arm member 22, as seen in FIG. 13. In an emergency situation, the lock arm member 22 may be lifted or moved away from the first handbar stop member 23 by inserting a wire, key, tool, etc. into pin rod 20 which protrudes through access slot 37. The pocket door panel 35 may still be opened from the inside by actuating the second handbar member 2, since the lockset does not interfere with the operating mechanism of the second handbar member 2.

Figure 16:
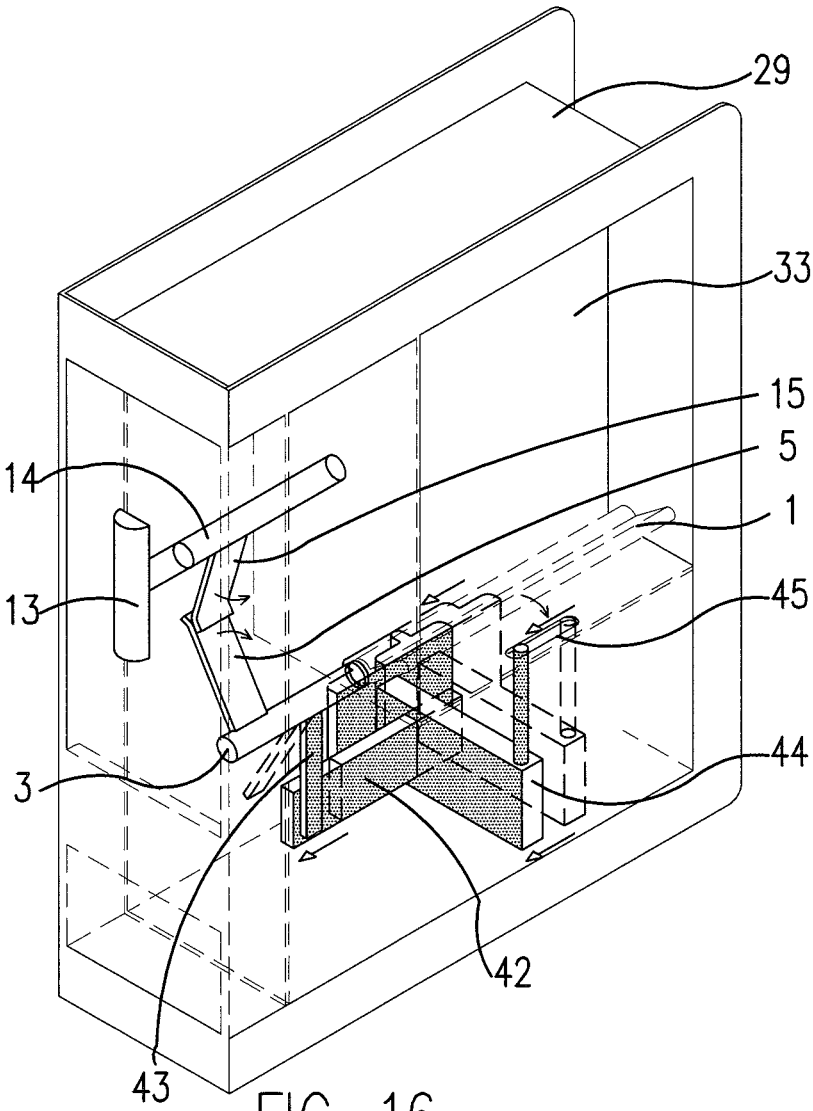
FIG. 16 is a partially exposed outside view of a second alternative embodiment of the latchset further comprising a lockset.
Figure 17:
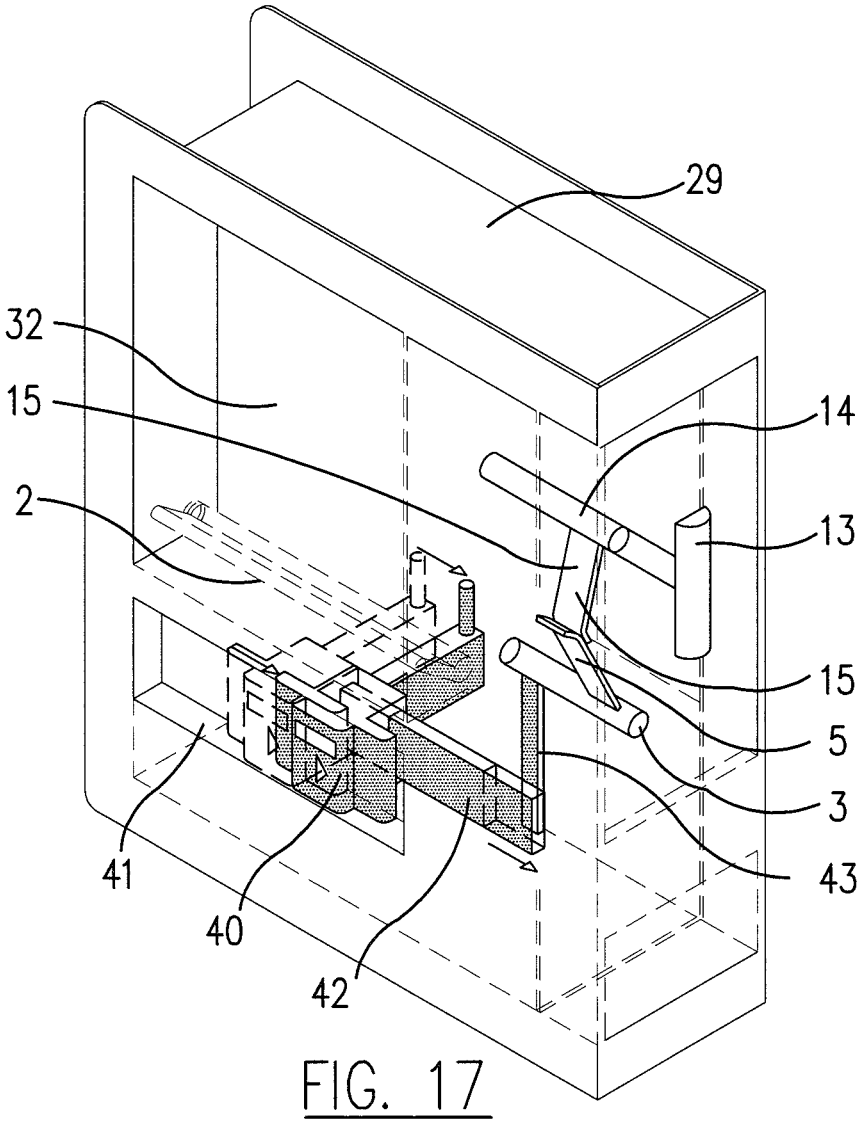
FIG. 17 is a partially exposed inside view of the second alternative embodiment of FIG. 16.
Figure 18:
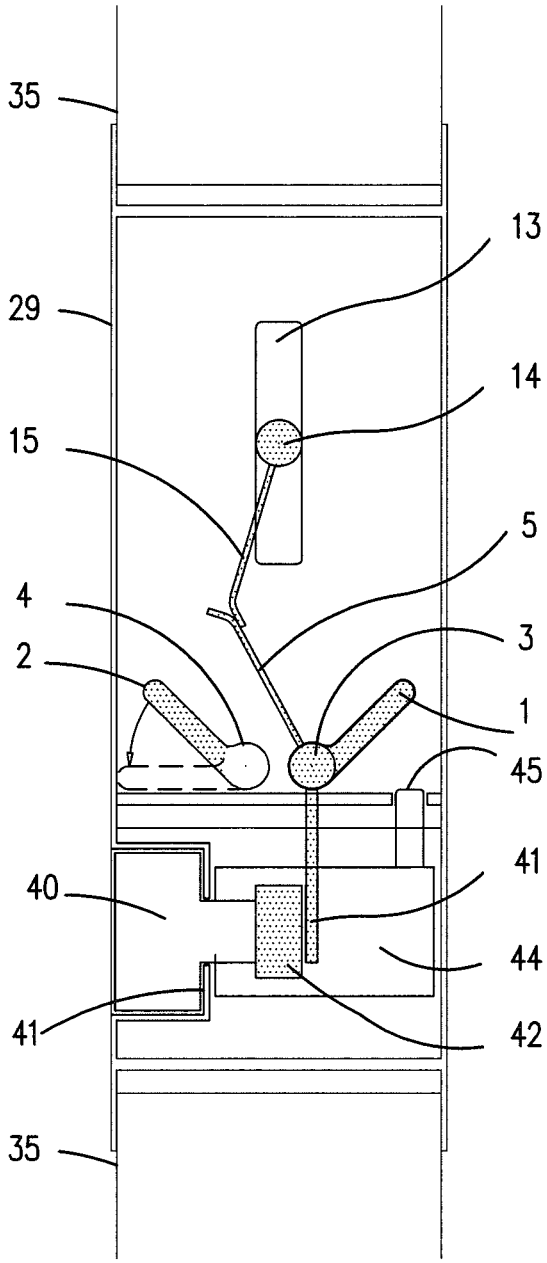
FIG. 18 is an exposed end view showing the second alternative embodiment of FIG. 16.

In a second alternative embodiment illustrated in FIGS. 16 through 18 in the locked position, the latchset is provided with an alternative privacy or lockset that enables the pocket door to be locked from the inside when closed, the lockset comprising a slide lock main body 40, a portion of which extends from or is accessible through a horizontal slide lock slot 41 in case 29, the slide lock slot 41 preferably located adjacent the second recess 32 on the inside of the door panel 35. The lockset further comprises a slide lock bar member 42 extending in the direction of the end of the case 29. A slide lock flange member 43 is joined to first handbar axle 3, extending downward as shown in the drawings. The length of the slide lock bar member 42 is chosen such that with the slide lock main body 40 moved away from the end of case 29, i.e., with the lockset in the retracted or non-locked position, the slide lock flange 43 is free to pivot when handbar axle 3 is rotated by depressing first handbar member 1 and the panel door 35 may be opened from the outside. To lock the panel door 35, slide lock main body 40 is moved toward the end of the case 29 such that the slide lock bar member 42 now extends into the rotational pathway arc of the slide lock flange 43. In this manner, the slide lock bar member 42 prevents rotation of the slide lock flange 43, thereby preventing rotation of the first handbar axle 3 and preventing opening of the panel door 35 from the outside. For safety purposes, a slide lock override extension member 44 may be provided, the override extension member 44 extending across case 29 such that a portion of the override extension member 44, such as a vertical post, may be positioned in or adjacent in an access slot 45 located in the first handbar recess 33. Using a wire, tool or like instrument, the override extension member 44 may be moved from the locked position to the open position, thereby retracting the slide lock bar member 42 and allowing the panel door 35 to be opened from the outside. The pocket door panel 35 may still be opened from the inside by actuating the second handbar member 2, since the lockset does not interfere with the operating mechanism of the second handbar member 2.

Figure 19:
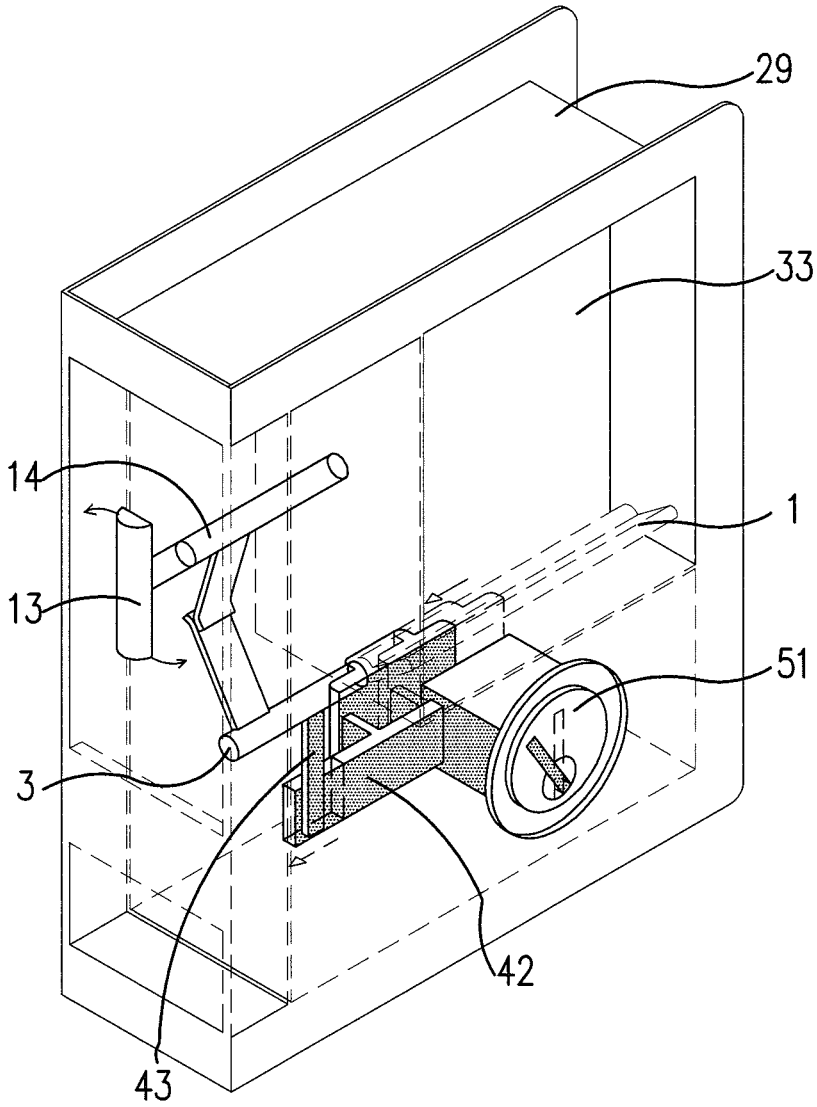
FIG. 19 is a partially exposed outside view of a third alternative embodiment of the latchset further comprising a lockset.
Figure 20:
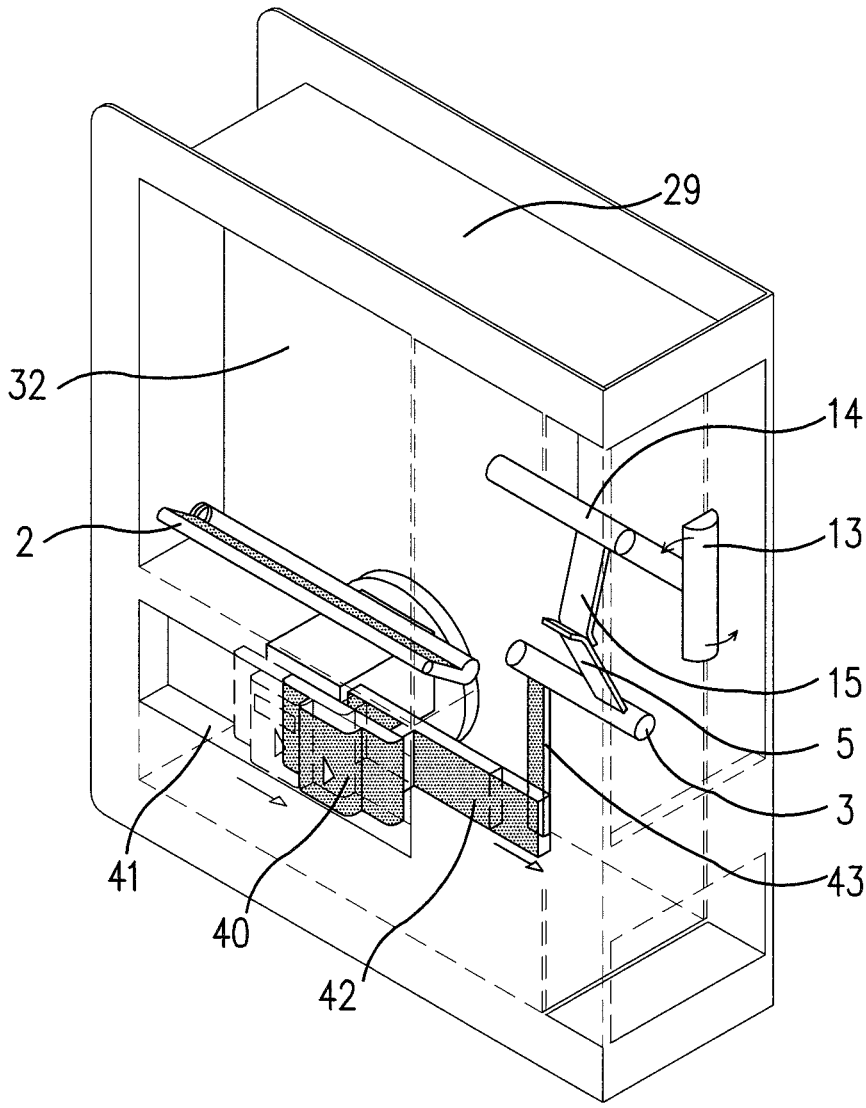
FIG. 20 is a partially exposed inside view of the third alternative embodiment of FIG. 19.

In a third alternative embodiment as shown in FIGS. 19 and 20 in the locked position, the pocket door latchset is provided with a lockset comprising a sliding bolt lockset similar in structure and function to the slide lockset described above relative to FIGS. 16 through 18, the lockset comprising a slide lock main body 40 and slide lock bar member 42 in the form of a bolt connected thereto, and a lock flange member 43 extending from the first handbar axle 3. In this embodiment, a deadbolt lock 51, operable by a key, electronic card or thumbturn member from the outside, is provided adjacent to first recess 33. The slide lock bar member 42 extends from the cylinder of the deadbolt lock 51 and functions in the same manner as that of the standard deadbolt, whereby rotation of the key or thumbturn in opposite directions extends and retracts the slide lock bar member 42. To lock the pocket door panel 35, the slide lock bar member 42 is extended to block the pivot pathway of the lock flange member 43 either by movement of the slide lock main body 40 from the inside or operation of the deadbolt lock 51 from the outside. The pocket door panel 35 may still be opened from the inside by actuating the second handbar member 2, since the lockset does not interfere with the operating mechanism of the second handbar member 2. In an alternative embodiment, the latchset may be provided without the slide lock main body 40, such that only deadbolt lock 51 is present.

It is understood that equivalents and substitutions for elements set forth above may be obvious to those of ordinary skill in the art, and therefore the true scope and definition of the invention is to be as set forth in the following claims.

I claim:

1. A sliding pocket door latchset adapted to releasably latch a panel door within a door frame having a channel to receive said panel door, said latchset comprising:

a case comprising an interior, a first handbar recess and a second handbar recess, said case adapted to be mounted within a panel door;

a keeper member mounted within a channel of a door frame;

a latch member mounted on a latch axle, said latch axle mounted within said case and defining an axial direction; whereby said latch member is adapted to interlock with said keeper member and is precluded from movement in the axial direction in the neutral position, and further whereby said latch member is rotatable from said neutral position by rotation of said latch axle such that said latch member is no longer interlocked with said keeper member and is movable in the axial direction;

a latch axle spring operatively connected to said latch axle;

a first handbar axle mounted within said case in parallel to said latch axle;

a first handbar axle spring operatively connected to said first handbar axle;

a first handbar member disposed within said first handbar recess and joined to said first handbar axle whereby depression of said first handbar member from the neutral position causes rotation of said first handbar axle from the neutral position and whereby upon release of said first handbar member said first handbar axle spring returns said first handbar axle and said first handbar member to the neutral position;

a first handbar axle cam extending radially outward from said first handbar axle;

a first latch axle cam extending radially outward from said latch axle, whereby said first latch axle cam abuts said first handbar axle cam such that depression of said first handbar member rotates said latch axle and said latch member from said neutral position and whereby upon release of said first handbar member said latch axle spring returns said latch axle and said latch member to the neutral position;

a second handbar axle mounted within said case in parallel to said latch axle;

a second handbar axle spring operatively connected to said second handbar axle;

a second handbar member disposed within said second handbar recess and joined to said second handbar axle whereby depression of said second handbar member from the neutral position causes rotation of said second handbar axle from the neutral position and whereby upon release of said second handbar member said second handbar axle spring returns said second handbar axle and said second handbar member to the neutral position;

a second handbar axle cam extending radially outward from said second handbar axle;

a second latch axle cam extending radially outward from said latch axle;

an idler axle mounted within said case in parallel to said latch axle;

a lower idler axle cam and an upper idler axle cam extending radially from said idler axle in opposite directions, whereby said lower axle idler cam abuts said second handbar axle cam and said upper idler axle cam abuts said second latch axle cam such that depression of said second handbar member rotates said latch axle and said latch member from said neutral position and whereby upon release of said second handbar member said latch axle spring returns said latch axle and said latch member to the neutral position.

2. The latchset of claim 1, further comprising:

a first handbar axle spring arm extending radially outward from said first handbar axle, said first handbar axle spring connected directly to said first handbar axle spring arm, whereby depression of said first handbar member causes extension of said first handbar axle spring;

a second handbar axle spring arm extending radially outward from said second handbar axle, said second handbar axle spring connected directly to said second handbar axle spring arm, whereby depression of said second handbar member causes extension of said second handbar axle spring;

a latch axle spring arm extending radially outward from said latch axle, said latch axle spring connected directly to said latch axle spring arm, whereby depression of said first or said second handbar member causes extension of said latch arm spring.

3. The latchset of claim 1, further comprising:

a privacy activation lever coaxially mounted onto said second handbar axle within said second recess, said privacy activation lever able to pivot independently to said second handbar member;

a lockarm member extending radially outward from privacy activation lever within said case, said lockarm member comprising an abutment surface;

a first handbar stop member extending radially outward from said first handbar axle;

whereby upon raising said privacy activation lever, said abutment surface of said lockarm member contacts said first handbar stop and precludes rotation of said first handbar axle and depression of said first handbar member.

4. The latchset of claim 2, further comprising:

a privacy activation lever coaxially mounted onto said second handbar axle within said second recess, said privacy activation lever able to pivot independently to said second handbar member;

a lockarm member extending radially outward from privacy activation lever within said case, said lockarm member comprising an abutment surface;

a first handbar stop member extending radially outward from said first handbar axle;

whereby upon raising said privacy activation lever, said abutment surface of said lockarm member contacts said first handbar stop and precludes rotation of said first handbar axle and depression of said first handbar member.

5. The latchset of claim 3, further comprising:

an access slot disposed in said first recess providing access to said lockarm member, whereby said lockarm member is movable to release said first handbar stop member, thereby allowing rotation of said first handbar axle and depression of said first handbar member.

6. The latchset of claim 4, further comprising:

an access slot disposed in said first recess providing access to said lockarm member, whereby said lockarm member is movable to release said first handbar stop member, thereby allowing rotation of said first handbar axle and depression of said first handbar member.

7. The latchset of claim 1, further comprising:

a slide lock slot disposed in said case adjacent said second recess;

a slide lock main body slidingly mounted within said case and accessible through said slide lock slot;

a slide lock bar member extending in the latchset axial direction from said slide lock main body;

a slide lock flange member extending radially outward from said first handbar axle;

wherein said slide lock main body and said slide lock bar member are movable in the axial direction between an unlocked position wherein said slide lock main bar member does not block movement of said slide lock flange member and said first handbar axle and a locked position wherein said slide lock main bar member precludes movement of said slide lock flange and said first handbar axle.

8. The latchset of claim 2, further comprising:

a slide lock slot disposed in said case adjacent said second recess;

a slide lock main body slidingly mounted within said case and accessible through said slide lock slot;

a slide lock bar member extending in the latchset axial direction from said slide lock main body;

a slide lock flange member extending radially outward from said first handbar axle;

wherein said slide lock main body and said slide lock bar member are movable in the axial direction between an unlocked position wherein said slide lock main bar member does not block movement of said slide lock flange member and said first handbar axle and a locked position wherein said slide lock main bar member precludes movement of said slide lock flange and said first handbar axle.

9. The latchset of claim 7, further comprising:

a slide lock extension member connected to said slide lock main body and extending toward said first recess;

an access slot disposed in said first recess providing access to said slide lock extension member, whereby said slide lock extension member is movable to move said slide lock main body into the unlocked position to no longer block movement of said slide lock flange member, thereby allowing rotation of said first handbar axle and depression of said first handbar member.

10. The latchset of claim 8, further comprising:

a slide lock extension member connected to said slide lock main body and extending toward said first recess;

an access slot disposed in said first recess providing access to said slide lock extension member, whereby said slide lock extension member is movable to move said slide lock main body into the unlocked position to no longer block movement of said slide lock flange member, thereby allowing rotation of said first handbar axle and depression of said first handbar member.

11. The latchset of claim 7, further comprising:

a deadbolt lock positioned adjacent said first recess; said slide lock bar member extending from said deadbolt lock, whereby operation of said deadbolt lock moves said slide lock bar member between the unlocked and locked position.

12. The latchset of claim 8, further comprising:

a deadbolt lock positioned adjacent said first recess; said slide lock bar member extending from said deadbolt lock, whereby operation of said deadbolt lock moves said slide lock bar member between the unlocked and locked position.

13. The latchset of claim 1, further comprising:

a latch recess positioned in said case, said latch axle extending into said latch recess and said latch member being positioned within said latch recess.

14. The latchset of claim 2, further comprising:

a latch recess positioned in said case, said latch axle extending into said latch recess and said latch member being positioned within said latch recess.

* * * * *